US011617429B2

(12) United States Patent
Lazar

(10) Patent No.: US 11,617,429 B2
(45) Date of Patent: Apr. 4, 2023

(54) MEDICAL SCRAPING TOOL FOR HUMAN NAILS OR SKIN

(71) Applicant: John Lazar, Bellport, NY (US)

(72) Inventor: John Lazar, Bellport, NY (US)

( * ) Notice: Subject to any disclaimer, the term of this patent is extended or adjusted under 35 U.S.C. 154(b) by 265 days.

(21) Appl. No.: 16/823,196

(22) Filed: Mar. 18, 2020

(65) Prior Publication Data

US 2020/0214420 A1 Jul. 9, 2020

Related U.S. Application Data

(63) Continuation-in-part of application No. 15/456,148, filed on Mar. 10, 2017, now Pat. No. 10,631,892.

(51) Int. Cl.
*A45D 29/17* (2006.01)

(52) U.S. Cl.
CPC ..... *A45D 29/17* (2013.01)

(58) Field of Classification Search
CPC .. A45D 19/17; A45D 29/02–2029/026; A45D 19/18; A61B 17/28; A61B 17/3201; A61B 17/54; A61B 17/320016; B25B 7/10; B25B 17/00–02; B26B 13/22–24; B26B 13/00–285
See application file for complete search history.

(56) References Cited

U.S. PATENT DOCUMENTS 2,127,190 A * 8/1938 Solomon ..... A61B 17/3201 606/174
2,753,626 A * 7/1956 Bowers ..... A45D 29/02 30/28
3,680,210 A * 8/1972 Steinman ..... A45D 29/02 30/28
4,062,109 A * 12/1977 Min ..... A45D 29/023 30/28
5,437,679 A * 8/1995 Gaillard ..... A45D 29/02 30/28
6,176,866 B1 * 1/2001 Christoudias ..... A61B 17/3201 606/174
2003/0065358 A1 * 4/2003 Frecker ..... A61B 17/29 606/205
2005/0257375 A1 * 11/2005 Wakefield ..... A45D 29/02 30/28
2008/0004650 A1 * 1/2008 George ..... B26B 13/08 606/174

(Continued)

*Primary Examiner* — Darwin P Erezo
*Assistant Examiner* — Brigid K Byrd
(74) *Attorney, Agent, or Firm* — Michael J. Feigin, Esq.; Feigin and Fridman LLC

(57) ABSTRACT

A scraping device has a scissor-like construction with two blades. Each blade can extend in a same plane as handle of the device. One of the blades is more dull than the other, the dull blade adapted to abut a part of the human body without causing any permanent physical change thereto, and the other being sharper than the dull blade which is designed to cut or remove part of the body. In some embodiments, one or both blades are rotatable in a plane which is normal to the direction of rotation of the handles relative to each other. In other embodiments, the blades are fixed at an angle relative to the handles and/or direction of movement of the handles. The dull blade may be inline with the handles while the sharp blade and/or cutting edge of the sharp blade is out of line therewith.

9 Claims, 9 Drawing Sheets

(56) References Cited

U.S. PATENT DOCUMENTS

2009/0308211 A1* 12/2009 McBride ..... B25B 7/04
30/191
2014/0041195 A1* 2/2014 Hoang ..... B25B 7/00
29/434

* cited by examiner

MEDICAL SCRAPING TOOL FOR HUMAN NAILS OR SKIN

FIELD OF THE DISCLOSED TECHNOLOGY

The disclosed technology relates generally to a scraping blade for the nails or skin, and more specifically to a tool with a cutting edge acutely angled to a direction of movement of the scraping.

SUMMARY OF THE DISCLOSED TECHNOLOGY

A scarping device of embodiments of the disclosed technology has a first and second handle which rotatably joined at a pivot joint (herein, also "joint"). Connected to/moving with each handle is a blade on the other side of the joint such that movement of a handle moves the blade in the same rotational direction around the pivot joint. One of the blades is a dull blade ("dull" being defined as a blade which, when placed against a surface of skin, does not ordinarily cause bleeding or cutting, or is not designed to cause bleeding or cutting). The other blade is a sharp blade ("sharp" being defined as a blade which, when placed into skin, does ordinarily cause bleeding or cutting, or is designed to cause bleeding or cutting).

The handles, blades, and pivot joints generally move or rotate within the same plane, such as an XY plane. Each has a longest linear or curvilinear extent extending within this XY plane as well, in embodiments of the disclosed technology. That is, the furthest straight (linear) or curved around an exterior side (curvilinear) distance is within the XY plane. However, an exception or difference to the longest extent being in the XY plane is made when one of the blades is rotated out of this plane into a XZ plane. In some embodiment, one or both blades is rotatable relative to the handles in the Z direction, placing the longest extent (linear and/or curvilinear) in an XZ plane. In other embodiments, one or both blades is fixed such that the longest extent (linear and/or curvilinear) are outside of the XY plane and in an XZ plane relative to the handles connected there-to.

As such, the sharp blade is designed to be twisted in and out of the XZ plane in some embodiment, and is permanently turned relative to the XY plane such that it is outside of the XY plane in longest extent and/or along a length of a cutting edge of the sharp blade. Such an angle of the cutting edge of the sharp blade can be between or exactly 25, 30, or 35 degrees which have been found to be optimal, in some uses, to shave/thin or smooth a toenail or fingernail and/or a growth there-on.

The dull blade is adapted to support a ventral side of a finger or toe while the cutting edge of the blade scrapes against a nail on a dorsal side of The finger or toe in embodiments of the disclosed technology. The joint allows rotation of the dull blade and the sharp blade, in some embodiments, only in the XY plane while the cutting edge of the sharp blade is offset from the XY plane in which the first handle and the second handle occupy (meaning, any such XY plane occupied by both the handles).

In a method of using the device, the dull blade is held under a ventral side of a finger or toe and the sharp blade is scraped, at an acute angle thereto, along a nail of The finger or the toe reducing thickness of the finger or the toe. When doing so, the sharp blade may be fixed at a 30 degree angle to the XY plane.

Described another way, a scraping device of embodiments of the disclosed technology has a first and second blade movable towards and away from each other by way of a pivot joint. The second blade can have a concave side opening towards the second blade. The first blade has a cutting edge at an (acute) angle offset to the direction that the first and second blade are movable towards and away from each other.

The angle of offset of the first blade relative to the direction that the first and the second blade are movable towards and away from each other is between 25 and 35 degrees in some embodiments, such as at 30 degrees. The first blade can be in a shape of a semi-ellipse (half ellipse).

A finger, toe, or other body part is then scraped, in embodiments of the disclosed technology, by moving the angle-offset blade along a surface thereof. This can thin a nail, smooth a nail, or remove a growth on a nail or skin.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

A scraping device has a scissor-like construction with two blades, each connected to a same joint at proximal ends thereof. Each blade can be curvilinear and extend in a same plane as handle of the device, the plane, for example, being in a plane where the handles and blades rotate around a pivot joint and relative to one another. One of the blades is more dull than the other, the dull blade adapted to abut a part of the human body without causing any permanent physical change thereto, and the other being sharper than the dull blade which is designed to cut or remove part of the body.

In some embodiments, one or both blades are rotatable in a plane which is normal to the direction of rotation of the handles relative to each other. In other embodiments, the blades are fixed at an angle relative to the handles and/or direction of movement of the handles. The dull blade may be inline with the handles while the sharp blade and/or cutting edge of the sharp blade is out of line therewith. "Inline" is defined as "extending in a longest curved or linear extent being in the same plane thereto." "Out of line" is defined as "extending in a longest curved or linear extent in a different plane therefrom."

Embodiments of the disclosed technology will become more clear in view of the following discussion of the drawings.

Figure 1:
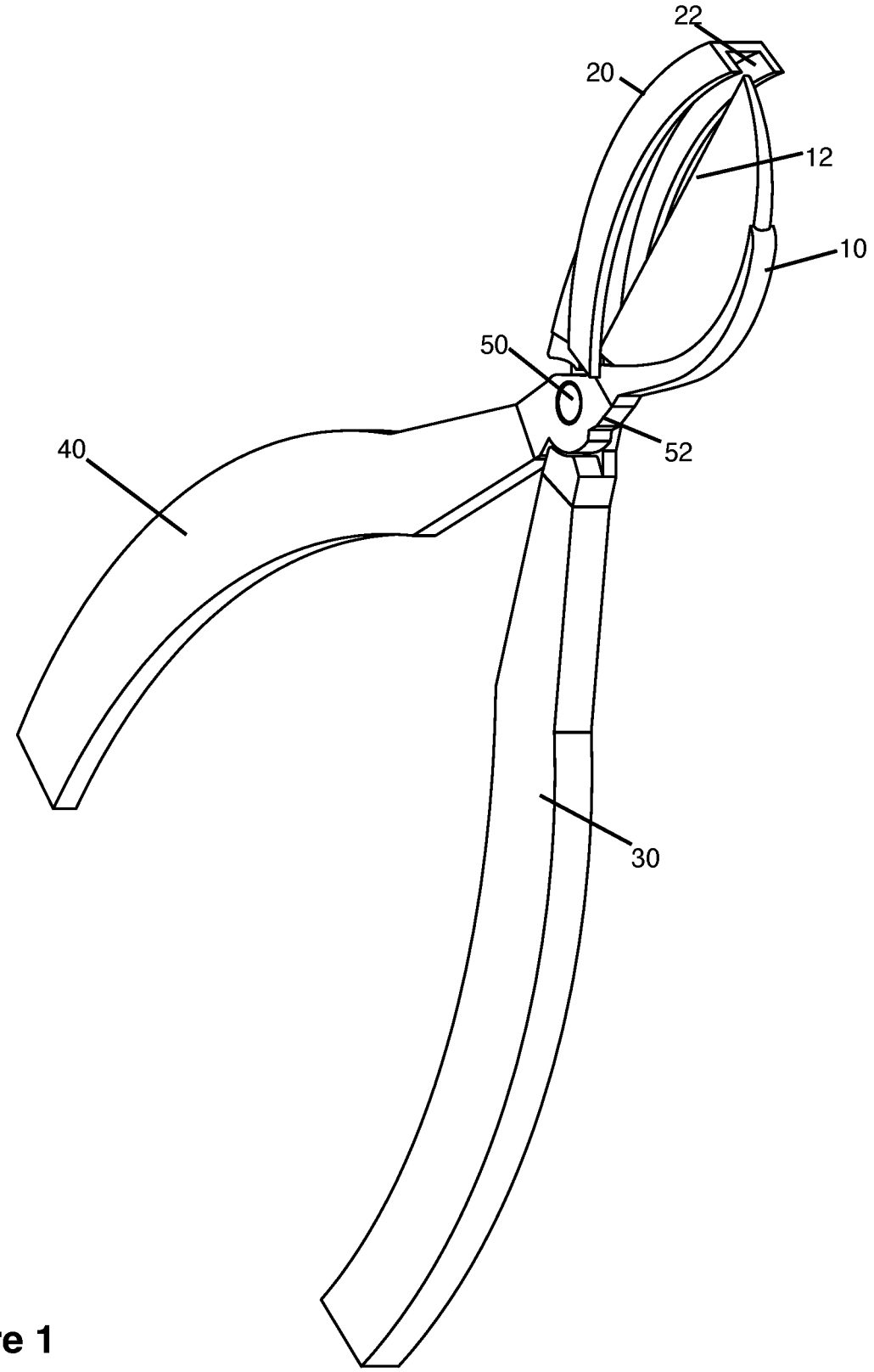
FIG. 1 shows a perspective view of a scraping device of embodiments of the disclosed technology in a closed configuration.
Figure 2:
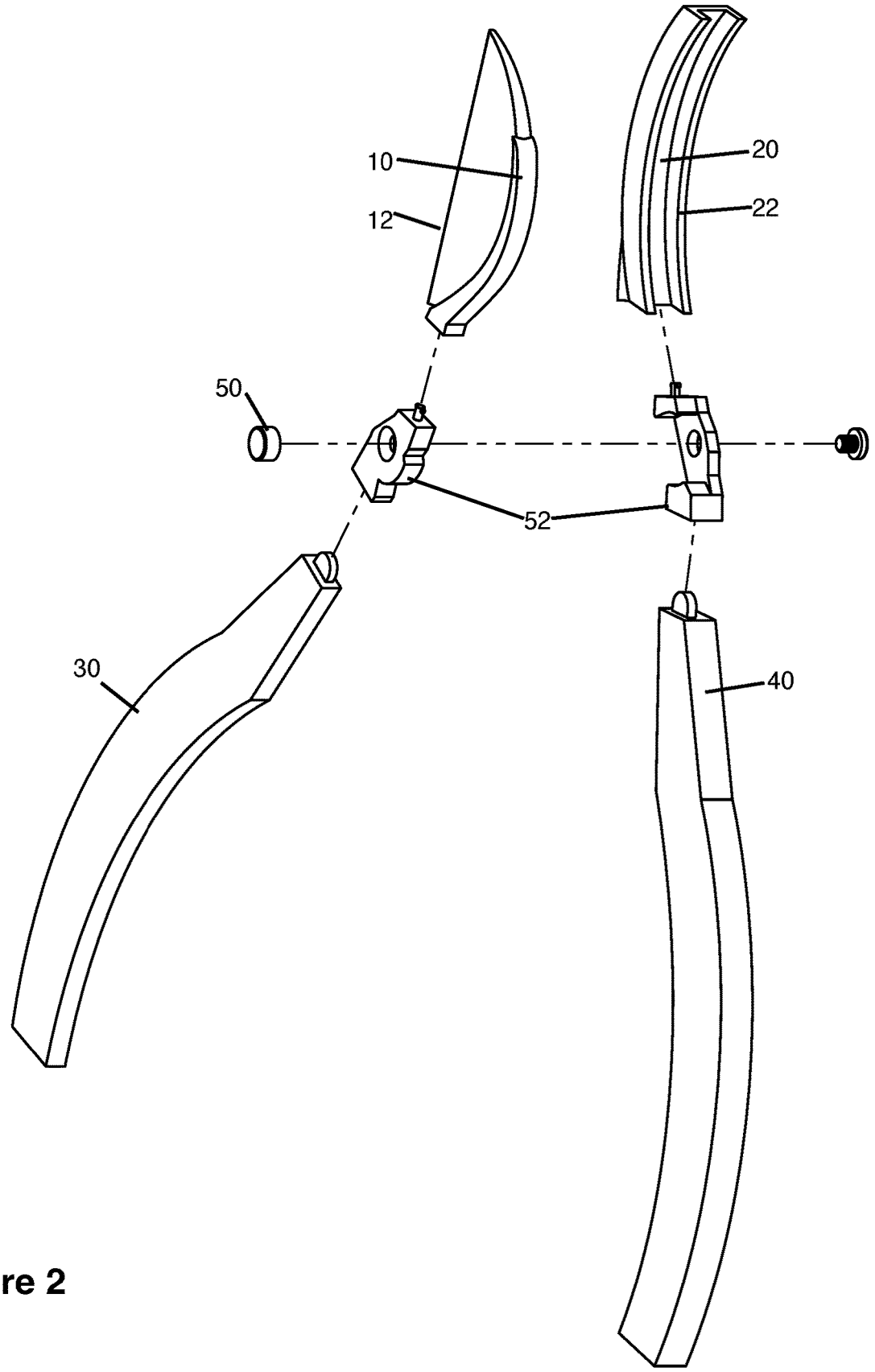
FIG. 2 shows an exploded view of the scraping device of FIG. 1.

FIG. 1 shows a perspective view of a scraping device of embodiments of the disclosed technology in a closed configuration. FIG. 2 shows an exploded view of the scraping device of FIG. 1. Here, the scraping device or tool has two handles 30 and 40. Each handle is joined at a fulcrum point/rotatable joint (such as a connector) 50 on connection pieces 52 which connect the handles to each other by way of the rotatable joint 50. The blades, including a dull blade 20 and sharp blade 10, further are rotatable relative to one another around the fulcrum or pivot joint 50. The blade 20 moves with the handle 30 and the blade 10 moves with the handle 40.

The above, with reference to FIGS. 1 and 2, describes movement in a same plane which for purposes of this disclosure will be called the XY plane. While this is a two dimensional plane, the movement of the handles and, as described above, the blades relative to one another is in this plane. When the blades 10 and 20 have an inside edge each facing towards one another, the entire device is said to be in the same XY plane and/or a combination of XY planes. In this configuration, each XY cut plane through the device is such that the cutting edge 12 of the blade, or a theoretical positioning of the cutting edge 12, is parallel to such an XY plane. It should be understood, as will be explained below, that the blades 10 and/or 20 can be rotated, or can be fixedly rotated, outside of the XY plane. "Fixed", "fixedly", and "permanently" are defined as "designed to remain at angle described during at least 100 uses of the device."

Figure 3:
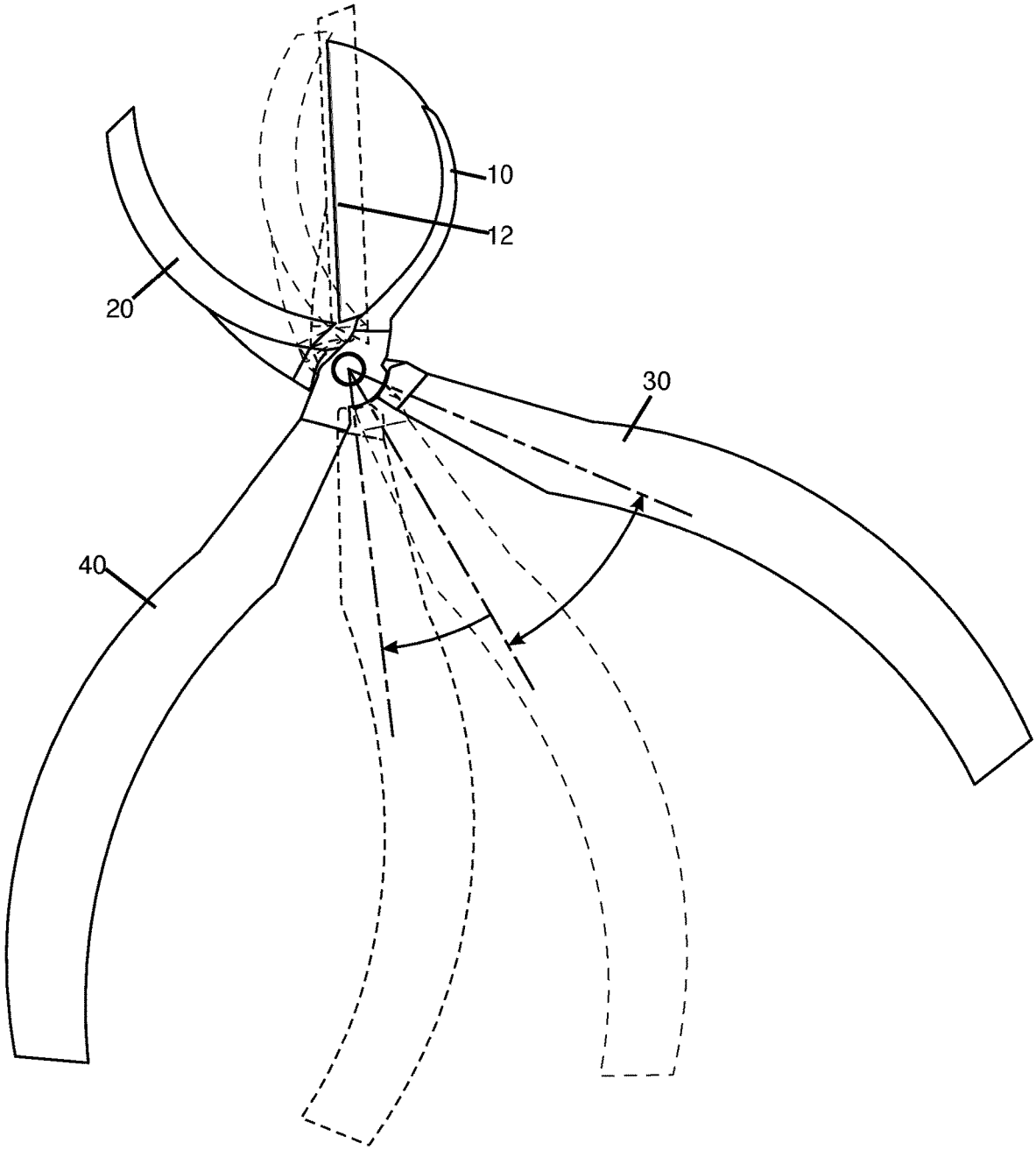
FIG. 3 shows a direction of closing/opening the scraping device of FIG. 1 in embodiments of the disclosed technology.

FIG. 3 shows a direction of closing/opening the scraping device of FIG. 1 in embodiments of the disclosed technology. In this figure, one can further see the movement of the handles 30 and 40 with respect to one another, causing the blades 10 and 20 to also move towards or away from each other along a same plane (e.g. XY planar movement). The arrows show the direction of movement and the dotted lines show where the parts of the device are positioned after such movement. Each handle can move independently with respect to the other handle while each blade moves in concert with an oppositely disposed handle. That is, sharp blade 10 moves with the handle 40 and dull blade 20 moves with the handle 30.

Figure 4:
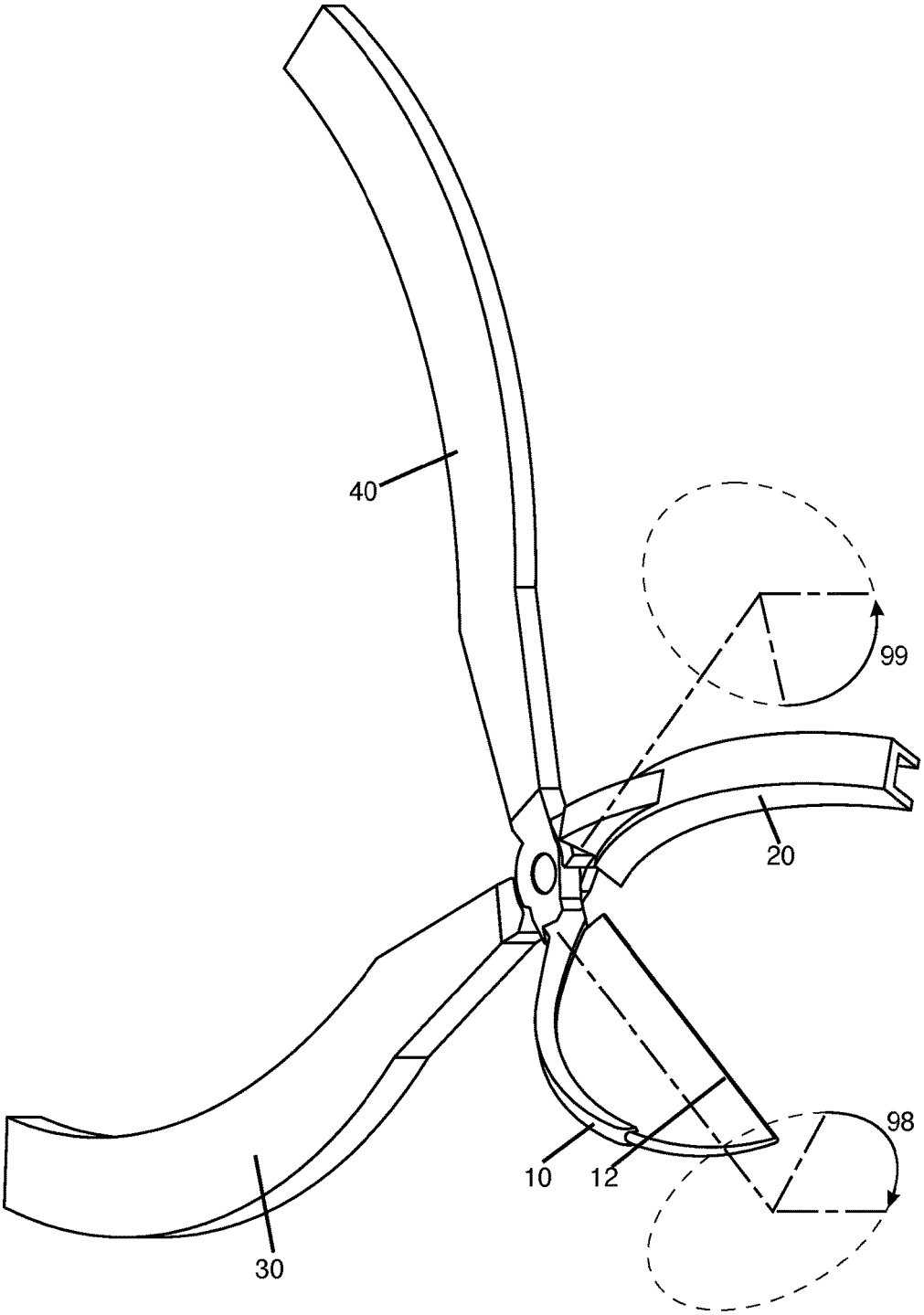
FIG. 4 shows a direction of rotating one or both blades of the scraping device of FIG. 1 in embodiments of the disclosed technology.
Figure 5:
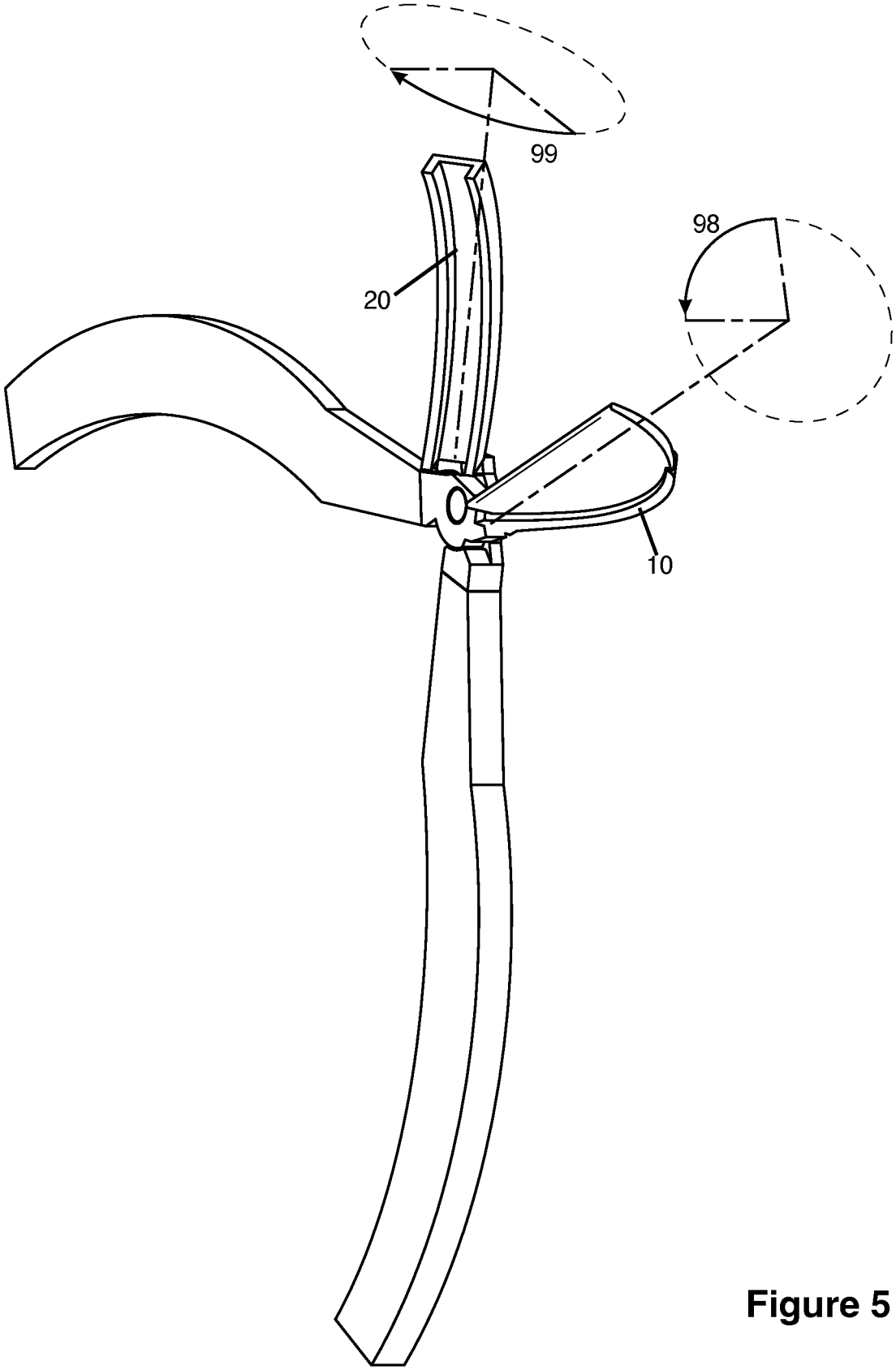
FIG. 5 shows a reverse angle view of the scraping device and rotating of one or both blades of FIG. 4.

FIG. 4 shows a direction of rotating one or both blades of the scraping device of FIG. 1 in embodiments of the disclosed technology. FIG. 5 shows a reverse angle view of the scraping device and rotating of one or both blades of FIG. 4. In some embodiments, one or both blades are rotatable with respect to the handles and/or each other. When rotated "with respect to each other" this refers to rotation such that the direction of rotation of one or both is perpendicular to that of the joint/fulcrum movement at number 50. In embodiments, the rotation of the sharp blade 10 is in the direction of the arc 98, and the rotation of the dull bade 20 is in the direction of the arc 99. In some embodiments, one or more blades is fixed in position relative to an oppositely disposed handle (e.g. blade 10 is fixed to the movement of handle 40, and/or blade 20 is fixed to the movement handle 30 such that another rotation of a blade without moving it's handle or the device as a whole is prevented).

The angle of the dull blade 20 may be set based on what will best allow the concave curvilinear side thereof to move across skin of a person smoothly or as smoothly as reasonable possible. The dull blade can have side flanges 22 which extend from a spine at a 90 degree angle thereto. The sharp blade 10, which refers to, for example, the entirety of the curvilinear flange connected to the semi-elliptical (half of an ellipse) portion with cutting edge 12. The cutting edge is used, in embodiments of the disclosed technology, to scrape across an exterior of a person such as their skin or nail to either thin, shave or smooth same. The cutting edge 10 may be moved to be, or permanently, out of line with the rest of the device. That is, it is an XZ plane compared to the handles which can further be viewed as being within an XY plane which the handles do not occupy. This XY plane of the cutting edge 12 of the sharp blade 10 is thus said to have been "turned" in an XZ direction making it in it's own XY plane that is different than any XY plane of the handles. Said yet another way, the cutting edge 12 is front most extent of the handle 30 and 40 as well as the joint 50 when considering the blades to be at the "top" and opposite extent of the handles as the "bottom."

Figure 6:
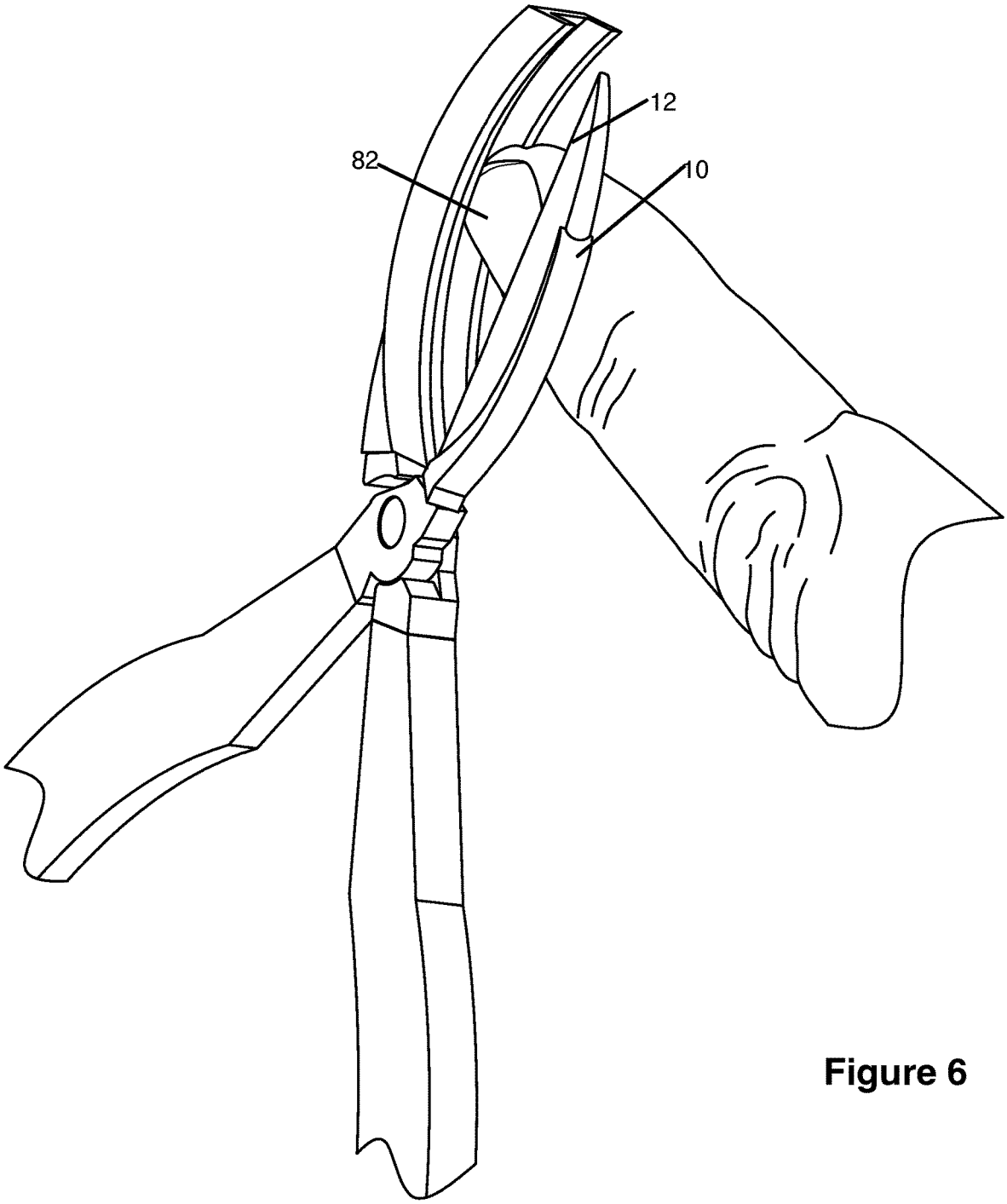
FIG. 6 shows use of the scraping device with a sharp blade twisted, out of a plane of, or relative to, handles of the scraping device in an embodiment of the disclosed technology.

FIG. 6 shows use of the scraping device with a sharp blade twisted, out of a plane of, or relative to, handles of the scraping device in an embodiment of the disclosed technology. Here, the cutting edge 12 and sharp blade 10 in general are at a 30 degree angle to the longest extent of the handles 30/40 as well as substantially the direction of the dorsal side of the finger (top side). Thus, when clamping the handles together, the dull blade 20 stays in place, abutting the extreme distal end of the finger and the cutting edge 12 of the sharp blade moves there-towards. The flanges 22 of the dull blade 20 allow the finger to be placed there-between in order to hold the finger in place while the sharp blade moves there-towards.

Figure 7:
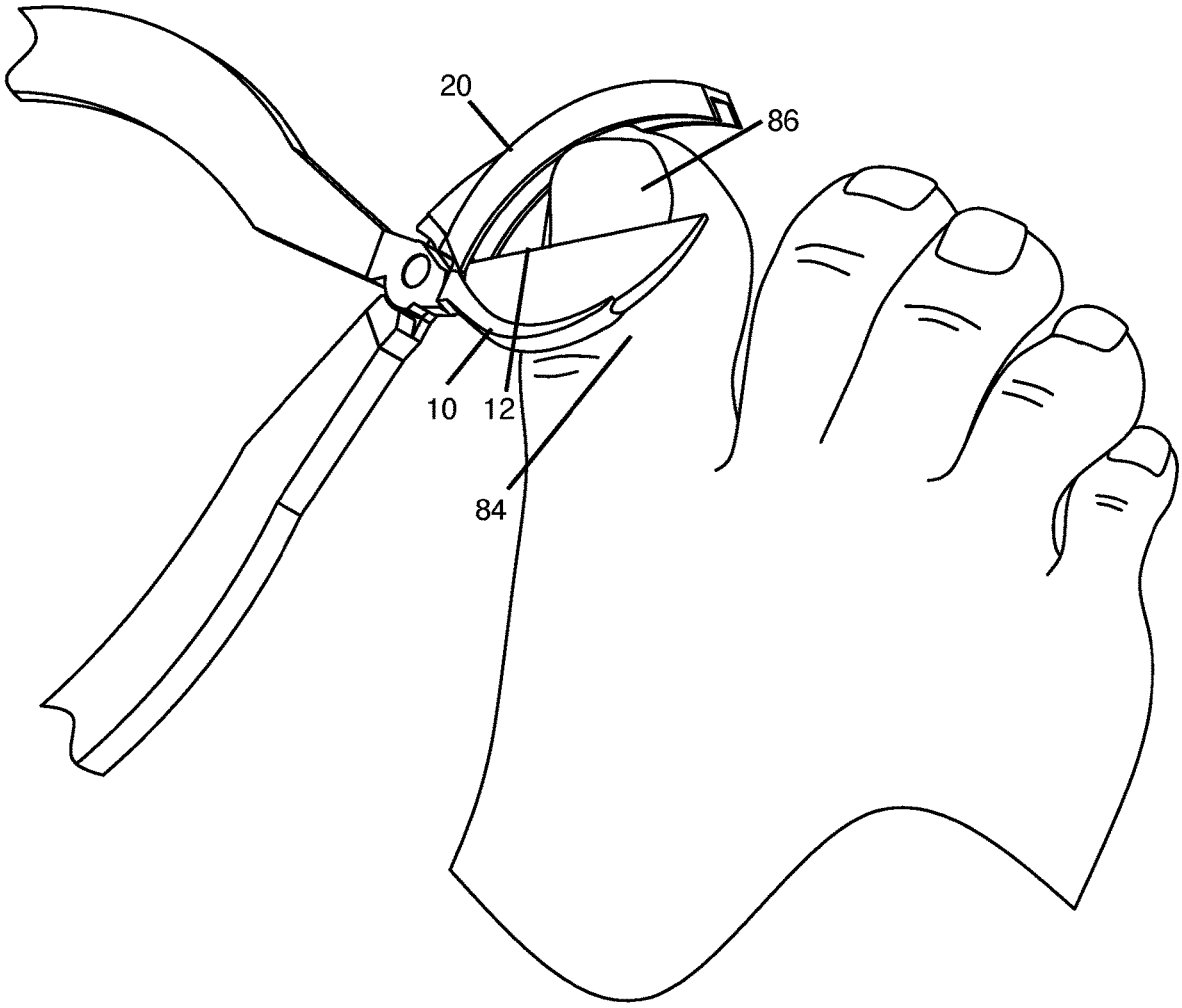
FIG. 7 shows the scraping device used on a toe, the scraping edge being at an angle relative to the handle of the device and direction of movement of the scraping device along a surface of a nail in an embodiment of the disclosed technology.

FIG. 7 shows the scraping device used on a toe, the scraping edge being at an angle relative to the handle of the device and direction of movement of the scraping device along a surface of a nail in an embodiment of the disclosed technology. Like that of FIG. 7, the scraping device is used likewise on a toe 84, the cutting edge 12 moving tangential or substantially tangential to a top surface of a nail 86 on the toe.

Figure 8:
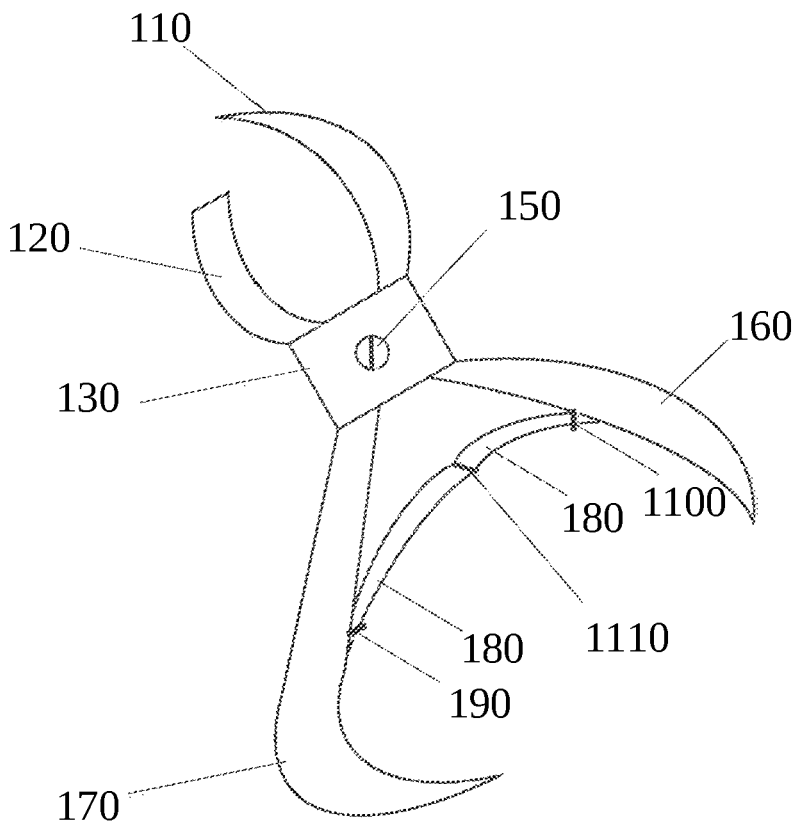
FIG. 8 is a top plan view of a scraping device.

FIG. 8 is a top plan view of an embodiment of the parent scraping device. As shown, the example embodiment comprises a blade 110, a base 130, a jaw 120, a central pivot 150, a top handle 160, a bottom handle 170, and a spring 180.

Figure 9:
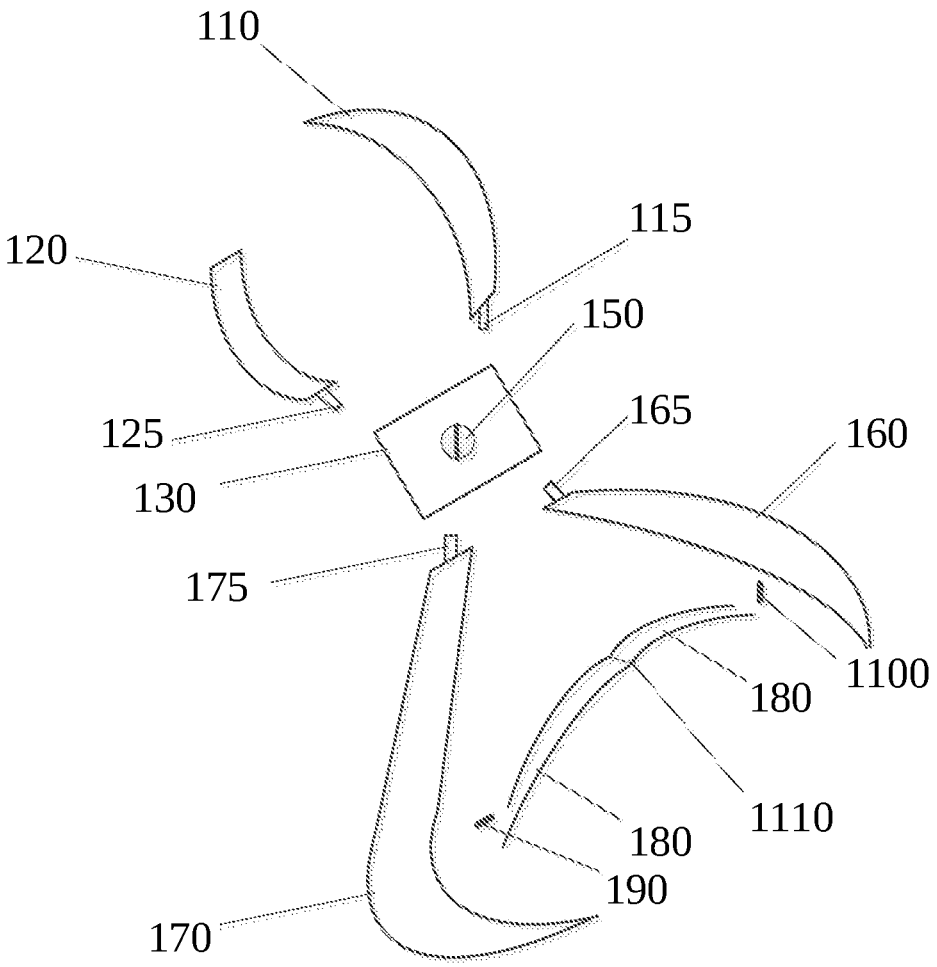
FIG. 9 is an exploded top view of the scraping device shown in FIG. 8.

Blade 110 is a standard angle blade that is sharp only along a single edge. Blade 110 is sharpened enough to debulk nails, without being excessively sharp so as to pose a danger to piercing skin. Blade 110 is attached to and removable from base 130, as illustrated in FIG. 9, by way of connector 115. Connector 115 is a threaded screw-type connector that is inserted and rotated into connection receiver 156. Blade 110 is adjustable in angle of connection by tightening or loosening of connector 115. It should be understood that alternate configurations of blade 110 are contemplated, such as a scissors blade or pliers jaw.

Jaw 120 is a generally rectangular-shaped component that is curved toward blade 110. Jaw 120 is composed of a hard but slightly malleable material such as plastic or rubber. Jaw 120 is attached to and removable from base 130 by means of connector 125 and shown in FIG. 9. Jaw 120 is adjustable in angle of connection by tightening or loosening of connector 125. It should be understood that alternate configurations of jaw 120 are contemplated, such as a scissors blade or pliers jaw.

The surface of jaw 120 that faces blade 110 is a curved surface composed of rubber, plastic, or another suitable material such as malleable steel that allows skin to rest against the surface without significant movement or slipping. Jaw 120 is sized and shaped appropriately to allow for a toe to be propped against it for debulking by blade 110.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A scraping device comprising:

a first handle coupled to a dull blade, said first handle and said dull blade each having a longest curvilinear or a longest linear extent extending generally in an XY plane, said dull blade including a curvilinear spine and two spaced-apart side flanges extending from two longest edges of said spine at a 90-degree angle with respect to said spine, said curvilinear spine curving from a distal end thereof to a proximal end thereof;

a second handle coupled to a sharp blade, said second handle and said sharp blade each having a longest curvilinear or a longest linear extent extending generally in said XY plane; and a joint, comprising a single fulcrum point, located at the proximal end of said dull blade and a proximal end of said sharp blade, said joint oriented to rotate said sharp blade and said dull blade in said XY plane;

wherein each of an entirety of said dull blade, from the proximal end thereof to the distal end thereof, and an entirety of said sharp blade, from the proximal end thereof to a distal end thereof, is rotatably movable with respect to each other in said XY plane by rotating said joint;

wherein said sharp blade has a cutting edge outside of said XY plane in an XZ plane while said dull blade has a dull edge within said XY plane.

2. The scraping device of claim 1, wherein said sharp blade further comprises:

a semi-elliptical portion; and a curvilinear flange;

wherein said semi-elliptical portion comprises said cutting edge at a straight edge thereof;

wherein said curvilinear flange extends along a majority of a curvilinear edge of said semi-elliptical portion; and wherein said sharp blade is permanently turned relative to said XY plane with said second handle having the longest curvilinear or linear extent extending generally in said XY plane.

3. The scraping device of claim 2, wherein an angle of said sharp blade to said XY plane is between 25 and 35 degrees.

4. The scraping device of claim 3, wherein said angle of said sharp blade is 30 degrees.

5. The scraping device of claim 1, wherein:

a curvilinear extent of said curvilinear spine includes a length larger than any other extent on the spine; and said two spaced-apart side flanges are substantially identical, said curvilinear spine and said two spaced-apart flanges defining a concave side having an opening rotatably orientable towards and away from the sharp blade.

6. The scraping device of claim 5, wherein said opening is adapted to support a ventral side of a finger or toe while said cutting edge of said sharp blade scrapes against a nail on a dorsal side of said finger or toe.

7. The scraping device of claim 6, wherein said joint allows rotation of said dull blade and said sharp blade only in said XY plane while said cutting edge of said sharp blade is offset from said XY plane in which said first handle and said second handle occupy.

8. A method of using said scraping device of claim 1, wherein said dull blade is held at a distal end of a toenail or fingernail while said sharp blade moves at an acute angle along said toenail or said fingernail of a finger or toe.

9. The method of claim 8, wherein said sharp blade is fixed at a 30-degree angle to said XY plane while said fingernail or said toenail is scraped.

* * * * *